US010822894B2

(12) United States Patent
Guerrero, Jr.

(10) Patent No.: US 10,822,894 B2
(45) Date of Patent: Nov. 3, 2020

(54) FLUID CONTAINMENT STRUCTURE AND SYSTEM

(71) Applicant: Jose Guerrero, Jr., Gillette, WY (US)

(72) Inventor: Jose Guerrero, Jr., Gillette, WY (US)

( * ) Notice: Subject to any disclaimer, the term of this patent is extended or adjusted under 35 U.S.C. 154(b) by 0 days.

(21) Appl. No.: 15/807,319

(22) Filed: Nov. 8, 2017

(65) Prior Publication Data

US 2019/0136651 A1 May 9, 2019

(51) Int. Cl.

| | |
|---|---|
| ***E21B 21/06*** | (2006.01) |
| ***E21B 33/06*** | (2006.01) |
| ***B65D 90/20*** | (2006.01) |
| ***E21B 43/26*** | (2006.01) |
| ***E21B 21/01*** | (2006.01) |
| ***E21B 33/068*** | (2006.01) |
| ***B65D 90/24*** | (2006.01) |
| *E04H 7/22* | (2006.01) |
| *B65D 90/02* | (2019.01) |
| *B65D 90/08* | (2006.01) |

(52) U.S. Cl.

CPC ..... *E21B 21/063* (2013.01); *B65D 90/24* (2013.01); *E21B 21/01* (2013.01); *E21B 33/068* (2013.01); *E21B 43/26* (2013.01); *B65D 90/024* (2013.01); *B65D 90/08* (2013.01); *B65D 90/205* (2013.01); *E04H 2007/225* (2013.01)

(58) Field of Classification Search

CPC ..... E02B 3/108; E02B 3/127; E02B 3/106; E02B 7/005; E02B 3/04; E02B 15/0885

USPC ..... 405/107, 110, 111, 115; 210/170.05, 210/170.09, 170.11, 242.3, 923

See application file for complete search history.

(56) References Cited

U.S. PATENT DOCUMENTS

| | | | | | |
|---|---|---|---|---|---|
| 73,318 | A * | 1/1868 | Gossins | E02B 3/10 | 405/107 |
| 352,544 | A * | 11/1886 | Kernaghan | E02B 3/10 | 405/107 |
| 1,480,380 | A * | 1/1924 | Elrod | E04H 15/48 | 135/99 |
| 2,515,059 | A * | 7/1950 | Rowbotham | E02B 3/106 | 405/110 |
| 2,609,666 | A * | 9/1952 | Mesnager | E02B 13/02 | 405/115 |
| 3,145,719 | A * | 8/1964 | Johnson | E04H 15/20 | 52/2.21 |
| 3,191,386 | A * | 6/1965 | Wiegel | E02B 3/062 | 405/25 |
| 3,213,628 | A * | 10/1965 | Serota | E02B 3/108 | 405/111 |
| 3,246,474 | A * | 4/1966 | Mesnager | E02B 7/005 | 405/115 |
| 3,373,568 | A * | 3/1968 | Hornbostel, Jr. | E02B 3/04 | 405/21 |
| 3,465,530 | A * | 9/1969 | Renfro John C | E02B 3/102 | 405/110 |
| 3,611,648 | A * | 10/1971 | Davis | E04H 9/10 | 52/2.17 |
| 3,834,167 | A * | 9/1974 | Tabor | E02B 7/005 | 405/115 |

(Continued)

*Primary Examiner* — Edwin J Toledo-Duran

(74) *Attorney, Agent, or Firm* — Lathrop GPM LLP

(57) ABSTRACT

A modular fluid containment system has wall segments that are joined at angled corners to form a closed wall. A membrane spans the closed wall and is connected to the closed wall with membrane attachment members. In some embodiments, a truss may span the closed wall and support a second membrane that protects impounded liquids from the environment.

13 Claims, 8 Drawing Sheets

(56) References Cited

U.S. PATENT DOCUMENTS 3,886,751 A * 6/1975 Porraz Jimenez Labora ..... E04C 1/40 405/107
4,000,585 A * 1/1977 Denaro ..... E04H 15/20 52/2.17
4,279,540 A * 7/1981 Suga ..... E02B 7/005 405/115
4,290,246 A * 9/1981 Hilsey ..... E02D 27/02 52/125.3
4,352,591 A * 10/1982 Thompson ..... E02B 7/005 210/170.01
4,498,810 A * 2/1985 Muramatsu ..... E02B 7/205 405/115
4,534,145 A * 8/1985 Yang ..... E04D 5/147 160/395
4,607,655 A * 8/1986 Wagner ..... E04H 15/20 135/116
4,638,532 A * 1/1987 Yang ..... E04D 5/143 160/395
4,650,368 A * 3/1987 Bayer ..... E02B 3/127 383/102
4,661,014 A * 4/1987 Aubert ..... E02D 17/20 405/111
4,662,783 A * 5/1987 Muramatsu ..... E02B 7/005 405/115
4,677,795 A * 7/1987 Mathews ..... E04D 5/142 52/222
4,681,302 A * 7/1987 Thompson ..... E01F 8/0035 256/13.1
4,692,060 A * 9/1987 Jackson ..... E02B 3/108 405/115
4,784,520 A * 11/1988 Stevens ..... E01D 19/02 405/21
4,787,774 A * 11/1988 Grove ..... E02B 7/005 405/101
4,799,299 A * 1/1989 Campbell ..... E04H 15/646 160/392
4,836,713 A * 6/1989 Muramatsu ..... E02B 7/005 405/115
4,909,666 A * 3/1990 Takasaki ..... E02B 7/005 405/115
4,921,373 A * 5/1990 Coffey ..... E02B 3/108 256/13
4,981,392 A * 1/1991 Taylor ..... E02B 3/108 405/115
5,059,065 A * 10/1991 Doolaege ..... E02B 3/127 405/107
5,067,851 A * 11/1991 Fujisawa ..... E02B 7/005 405/115
5,173,344 A * 12/1992 Hughes ..... C09K 3/10 405/107
5,176,468 A * 1/1993 Poole ..... E02B 3/04 405/111
5,325,646 A * 7/1994 Hallsten ..... E04B 7/08 52/246
5,388,928 A * 2/1995 Kumagai ..... E02B 7/005 405/115
5,454,195 A * 10/1995 Hallsten ..... B65D 90/24 220/495.01
5,470,177 A * 11/1995 Hughes ..... E02B 3/108 405/107
5,617,677 A * 4/1997 Hallsten ..... E04B 7/08 52/23
5,689,920 A * 11/1997 Hallsten ..... B65D 90/24 220/495.01
5,865,564 A * 2/1999 Miller ..... E02B 3/108 405/114
6,022,172 A * 2/2000 Siyaj ..... E02B 3/108 405/110
6,059,491 A * 5/2000 Striefel ..... E01F 15/086 256/13.1
6,079,904 A * 6/2000 Trisl ..... E02B 3/106 405/107
6,126,362 A * 10/2000 Carter ..... E02B 3/108 405/114
6,132,140 A * 10/2000 Kullberg ..... E02B 7/22 405/114
6,186,701 B1 * 2/2001 Kempers ..... E02B 3/127 405/19
6,296,420 B1 * 10/2001 Garbiso ..... E02B 3/108 383/69
6,312,192 B1 * 11/2001 Dery ..... E02B 3/108 405/107
6,390,154 B1 * 5/2002 Hall ..... E02B 3/108 141/314
6,481,928 B1 * 11/2002 Doolaege ..... E01D 15/20 138/98
6,672,799 B2 * 1/2004 Earl ..... E02B 3/04 404/6
6,672,800 B2 * 1/2004 Frank ..... E02B 3/108 405/114
6,676,333 B2 * 1/2004 Wiseman ..... E02B 3/106 405/114
6,715,960 B2 * 4/2004 Metz ..... E02B 3/108 405/111
7,029,200 B1 * 4/2006 Cravens ..... E02B 3/04 405/111
7,178,483 B2 * 2/2007 Wu ..... A01K 1/033 119/498
7,648,754 B2 * 1/2010 Halahmi ..... E02D 17/20 405/111
7,708,495 B1 * 5/2010 Antee ..... E02B 3/108 405/111
8,434,967 B2 * 5/2013 Nero ..... E06B 3/984 405/107
8,540,456 B2 * 9/2013 Marshall ..... B65D 90/24 405/107
8,702,345 B2 * 4/2014 Stein ..... B08B 17/025 405/107
9,016,980 B2 * 4/2015 Wheeler ..... B09C 1/00 405/129.45
9,944,046 B2 * 4/2018 Winters ..... E04C 1/00
10,415,210 B2 * 9/2019 Powell ..... E02D 31/004
10,435,856 B2 * 10/2019 Winters ..... B08B 17/025
2002/0110424 A1 * 8/2002 Page ..... E02B 3/108 405/115
2003/0161688 A1 * 8/2003 Frank ..... E02B 3/108 405/115
2004/0156680 A1 * 8/2004 Gibbs ..... E02B 3/06 405/15
2004/0234340 A1 * 11/2004 Cho ..... E02B 3/106 405/107
2004/0265063 A1 * 12/2004 Kullberg ..... E02B 3/106 405/107
2005/0260038 A1 * 11/2005 Sousa Costa ..... E02B 3/127 405/115
2006/0099033 A1 * 5/2006 Boraggina ..... E02B 3/108 405/107
2006/0275084 A1 * 12/2006 Harbeck ..... E02B 3/108 405/116
2009/0041543 A1 * 2/2009 Kroger ..... B65D 90/24 405/114
2009/0226260 A1 * 9/2009 Boulton ..... E03B 11/14 405/55
2010/0129156 A1 * 5/2010 Taylor ..... E02B 3/108 405/114
2012/0201603 A1 * 8/2012 Boulton ..... E03B 11/14 405/36
2013/0071188 A1 * 3/2013 Taylor ..... E02B 3/106 405/114
2014/0308078 A1 * 10/2014 Mulvihill ..... E02B 3/106 405/16
2016/0168859 A1 * 6/2016 Vargas ..... E04D 13/064 52/716.2
2016/0236860 A1 * 8/2016 Winters ..... B32B 5/024

* cited by examiner

FLUID CONTAINMENT STRUCTURE AND SYSTEM

BACKGROUND

Fluid is often used when drilling or fracking oil wells. The fluid is frequently stored adjacent the well in a storage tank until it is used. Storage tanks may leak or otherwise inadvertently discharge the contained fluid. The unintended discharge of fluid may create an environmental hazard and fluid storage tanks are typically encircled by a containment system that is designed to catch any fluid that may leak from the storage tank.

One common system uses large preformed plastic interconnected barrier segments that are positioned around the space where the tank will be placed. Once in place, the barriers are designed to be filled with water to give them sufficient mass to stay in place. Once the preformed barrier segments are positioned, an impervious membrane can be positioned over the resulting barrier.

This system is costly to transport because the preformed barrier segments are bulky. This system is time consuming to set up because each barrier segment is bulky and should be filled with water once in place. Generally speaking, operators of a drill site seek to minimize the amount of time third-party contractors are on the site setting up containment systems. The preformed plastic barrier system is relatively time consuming to set up and even more time is required to fill each segment with water. If the system is used where it freezes, the barrier segments will break unless additional time and expense is invested in assuring that each plastic barrier segment is filled with a fluid that will not freeze.

Another common system used for taller containment systems utilizes steel plates that are formed with a slight arc such that, when connected to each other, the joined plates form a circle. The plates are heavy and are typically placed with a forklift. The plates are inherently unstable and are very difficult to position in a windy environment. In fact, the panels may be blown over as they are being positioned. Because they are heavy and unstable, they present a danger to those attempting to assemble a containment system using steel plates. Additionally, because of their weight and inherent instability, assembly is time consuming and dangerous.

SUMMARY OF EMBODIMENTS

Embodiments comprise a fluid impervious membrane overlapping a barrier wall made up of a plurality of interconnected wall segments. The wall segments are made up of a plurality of generally horizontally extending pre-formed members that are joined at a first and a second end of the wall segments. A planar member spans the distance between a top horizontally extending wall member and a bottom horizontally extending wall member on the interior of the wall segment. In one embodiment, the fluid impervious membrane is positioned between adjacent horizontally extending pre-formed members and a membrane securing member is interposed between the same adjacent horizontally extending pre-formed members such that the fluid impervious membrane is between the adjacent horizontally extending pre-formed members and the membrane securing member. In one embodiment, a tensioning member connects opposing wall segments.

In some embodiments, a fluid containment system has a fluid impervious membrane that spans a closed wall. The closed wall has a first and second wall segment. The wall segments are made of four, generally horizontal, tubular members joined at generally triangular plates at the ends of the wall segments. A generally planer member spans the distance between two of the generally horizontal tubular members on one side of the wall segments. A corner member is used to join adjacent wall segments such that the joined wall segments are non-linear. Corner members enable wall segments to be joined such that a plurality of wall segments may form a closed wall. A membrane securing member is placed between adjacent generally horizontal tubular members with the fluid impervious membrane interposed between the membrane securing member and the adjacent generally horizontal tubular members. In one embodiment, a tensioning cable joins opposing wall segments in the closed wall. In one embodiment, a plurality of tensioning cables joins opposing wall segments through connection to a bridle.

In some embodiments, a barrier wall has a slot. The slot has slot walls. A fluid impervious membrane spans the barrier wall and is interposed between the slot walls and a fluid impervious membrane securing member inserted between the slot walls. In some embodiments, a second fluid impervious membrane is supported by a truss that has truss supports. At least one truss support has a foot that may be inserted in the barrier wall slots to support the truss and to connect the truss to the barrier wall. The foot may also secure the second fluid impervious membrane to the barrier wall.

SUMMARY OF EMBODIMENTS

Embodiments of a fluid containment structure system discussed herein provide a fluid containment system that is not bulky, and therefore may be shipped efficiently. The components of smaller system may be assembled relatively quickly by two men. The preassembled wall segments are sufficiently light that two men can typically safely position the segments in place. For taller systems, a small forklift may be required to position the wall segments but the wall segments are inherently stable and are not easily toppled by common wind forces. Only three bolts are needed to connect adjacent segments in some embodiments and assembly typically takes less than one third of the time required to properly assemble previously known barrier system. Because embodiments herein do not require fluid to provide mass, the system may be used in colder climates without concern. Embodiments may also be used to create a barrier wall having variable configurations which enable adaptation to varying topography.

DETAILED DESCRIPTION

Figure 1:
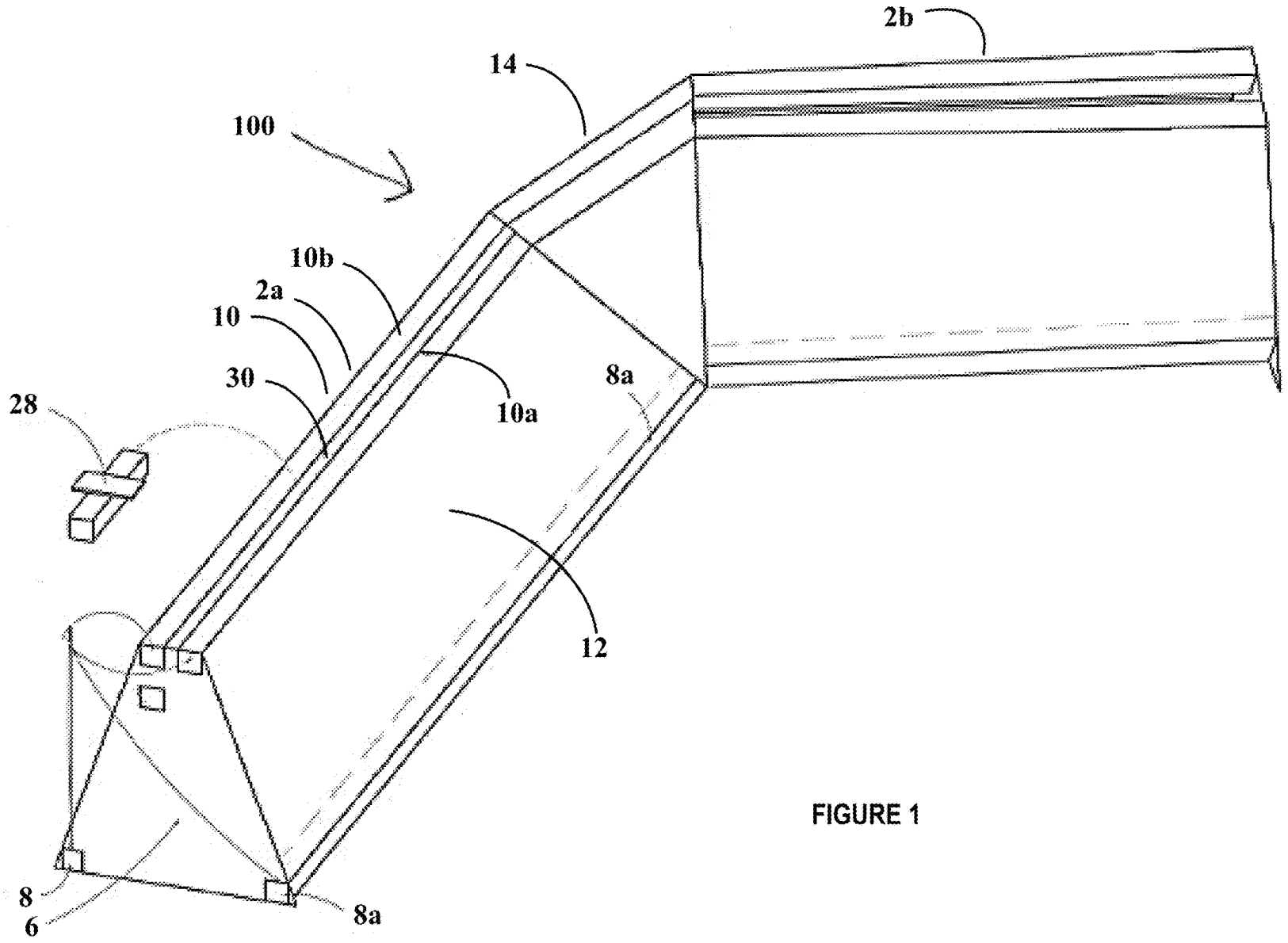
FIG. 1 depicts a perspective view of a fluid containment structure system.
Figure 2:
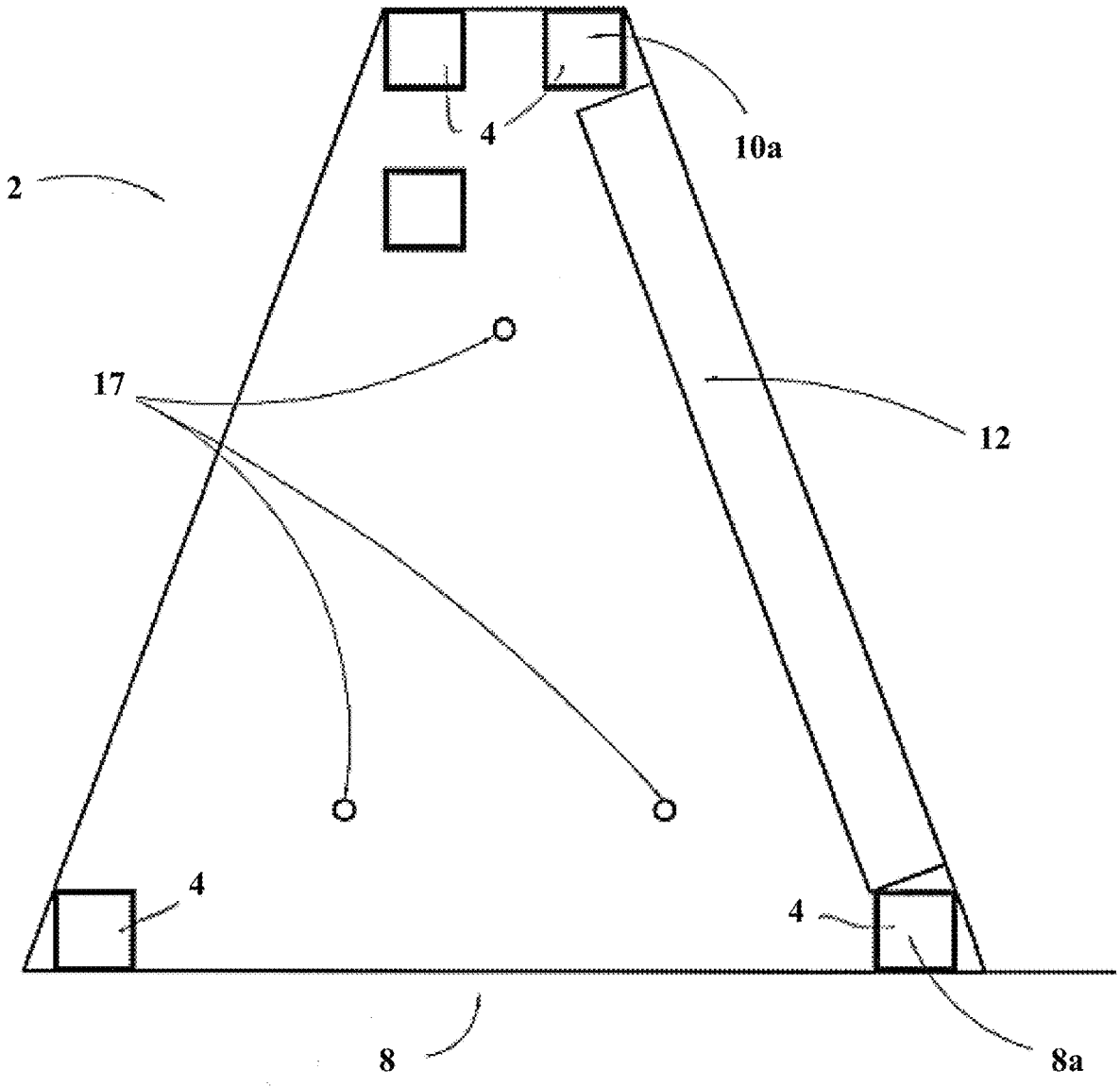
FIG. 2 depicts a plan view of the system of FIG. 1.
Figure 3B:
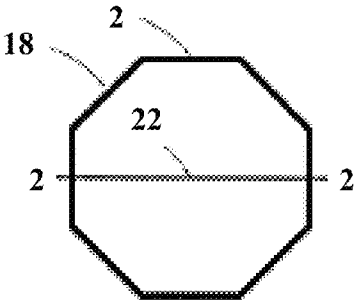
FIGS. 3A-3C depict example installation configurations of the system of FIGS. 1-2.
Figure 3C:
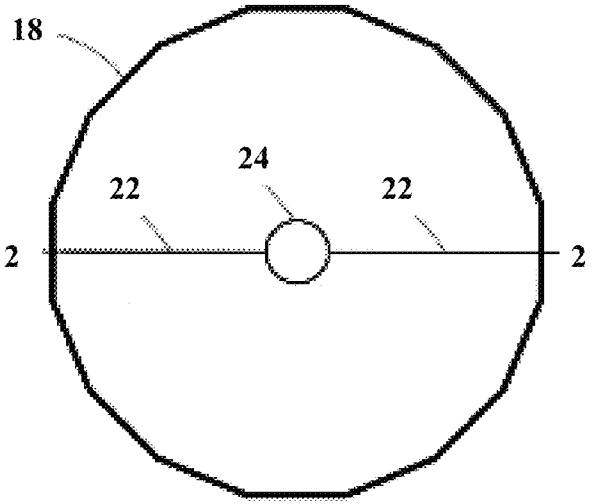
Figure 3A:
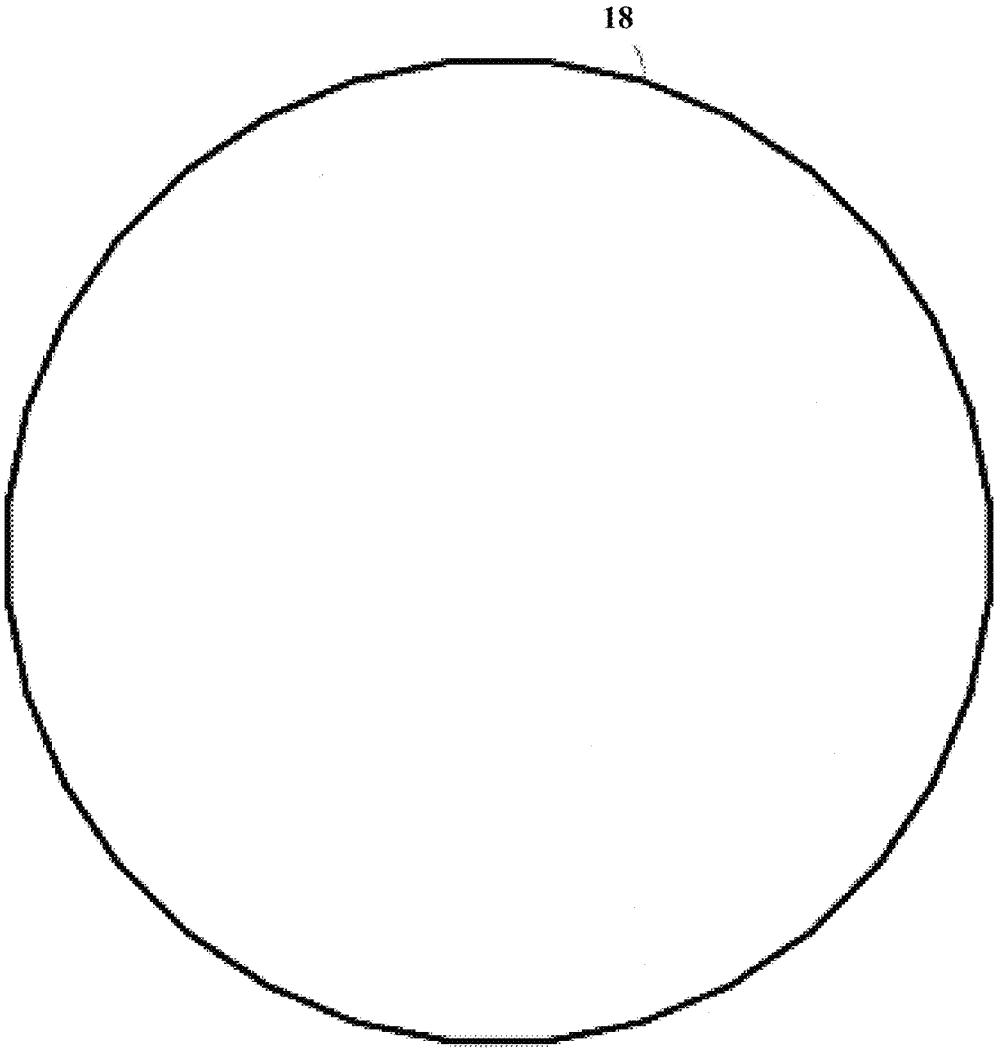
Figure 4A:
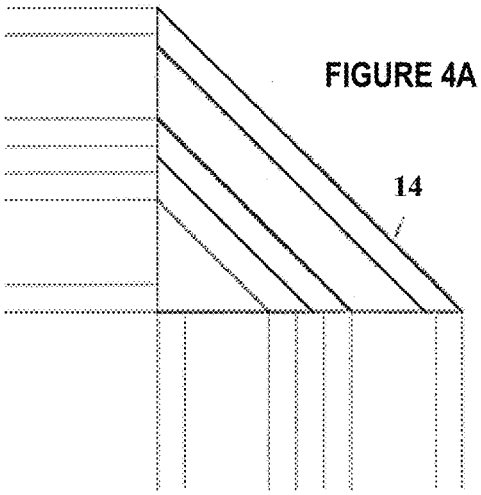
FIG. 4A-4D depict examples of the angled member for use with the system of FIGS. 1-3C.
Figure 4B:
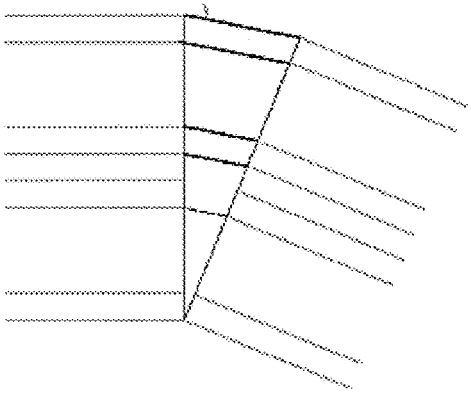
Figure 4C:
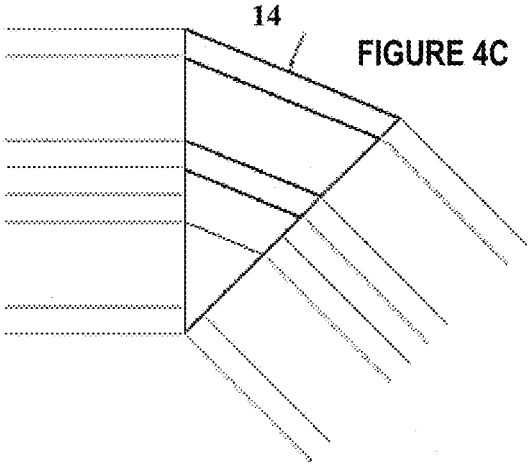
Figure 4D:
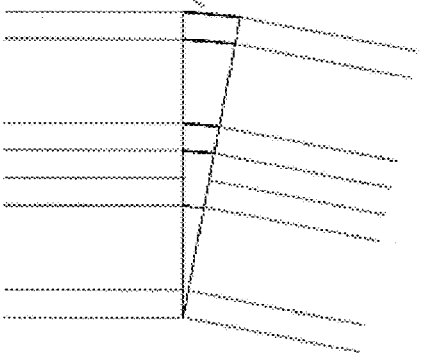

FIG. 1 depicts a perspective view of a fluid containment structure system 100, in embodiments. FIG. 2 depicts a plan view of the system 100 of FIG. 1. FIGS. 3A-3C depict example installation configurations of the system 100 of FIGS. 1-2. FIG. 4A-4D depict examples of the angled member 14 for use with the system 100 of FIGS. 1-3C, in embodiments. FIGS. 1-4D are best viewed together with the following description.

System 100 includes a wall segment 2 which includes four lengths of square tubing 4 attached to generally triangular end plates 6. It should be appreciated that square tubing 4 may be attached to triangular end plates 6 in one or more of a variety of ways, including welding, bonding, adhering, coupling via fasteners (screws, nails, bolts, etc.) without departing from the scope hereof. Two lengths of square tubing 4 form the base 8 of the wall segment 2. Two lengths of the square tubing 4 are spaced apart to form the top 10 of the wall segment 2. A plate 12 spans the distance between the inner top square tubing 10*a* and the inner base square tubing 8*a*. One of ordinary skill will appreciate that square tubing 4 may be replaced with other structural members and that the cross-sectional shape of the wall segment 2 need not be triangular, but may be any arbitrary shape without departing from the scope hereof. Moreover, other known connection methods may be used to join the components of the wall segment 2, and the wall segment could assume different shapes or have different numbers of component pieces without departing from the scope hereof.

In one embodiment, an angular member 14 joins adjacent wall segments 2*a*, 2*b*. The angular member 14 is joined to adjacent wall segments 2*a* and 2*b* with bolts 16 (not shown) through bolt holes 17. When joined to an angular member 14, adjacent wall segments 2*a*, 2*b* are angled with respect to one another and when sufficient additional wall segments 2 and angled members 14 are joined, a closed wall 18, as shown in FIGS. 3A, 3B and 3C may be formed.

Embodiments described herein provide a significant advantage of versatility of use of the system 100. With angled members 14 having a variety of angles (See FIGS. 4A, 4B, 4C and 4D for depictions of exemplary angles. Alternative angular configurations will be obvious to one of skill in the art.), the layout of the closed wall 18 is variable and may be adapted to terrain features existent on any given site. The wall segments 2 may be readily scaled to accommodate closed walls 18 that are relatively short (2-3 feet) or that are relatively tall (6-7 feet), as long as the relative proportions of the wall segment 2 are generally maintained. One of ordinary skill will appreciate that adjacent wall segments 2 may be joined to angular members 14 with any suitable attachment means such as, but not limited to, bolts, screws, nails, glue, welding, etc. Moreover, one of ordinary skill will appreciated that, if the end plates 6 of the wall segments 2 are not perpendicular to the longitudinal axis of the wall segment 2, a closed wall 18 may be formed without using angled members 14.

In certain embodiments, the force of retained fluids may be sufficient to move opposing wall segments 2 away from each other. To counteract this force, cables 22 may connect opposing wall segments 2. The cables 22 may directly connect opposing wall segments 2 or may connect through an intermediate ring 24. One of skill will understand other tensioning members may be used in lieu of the cables 22.

Figure 5A:
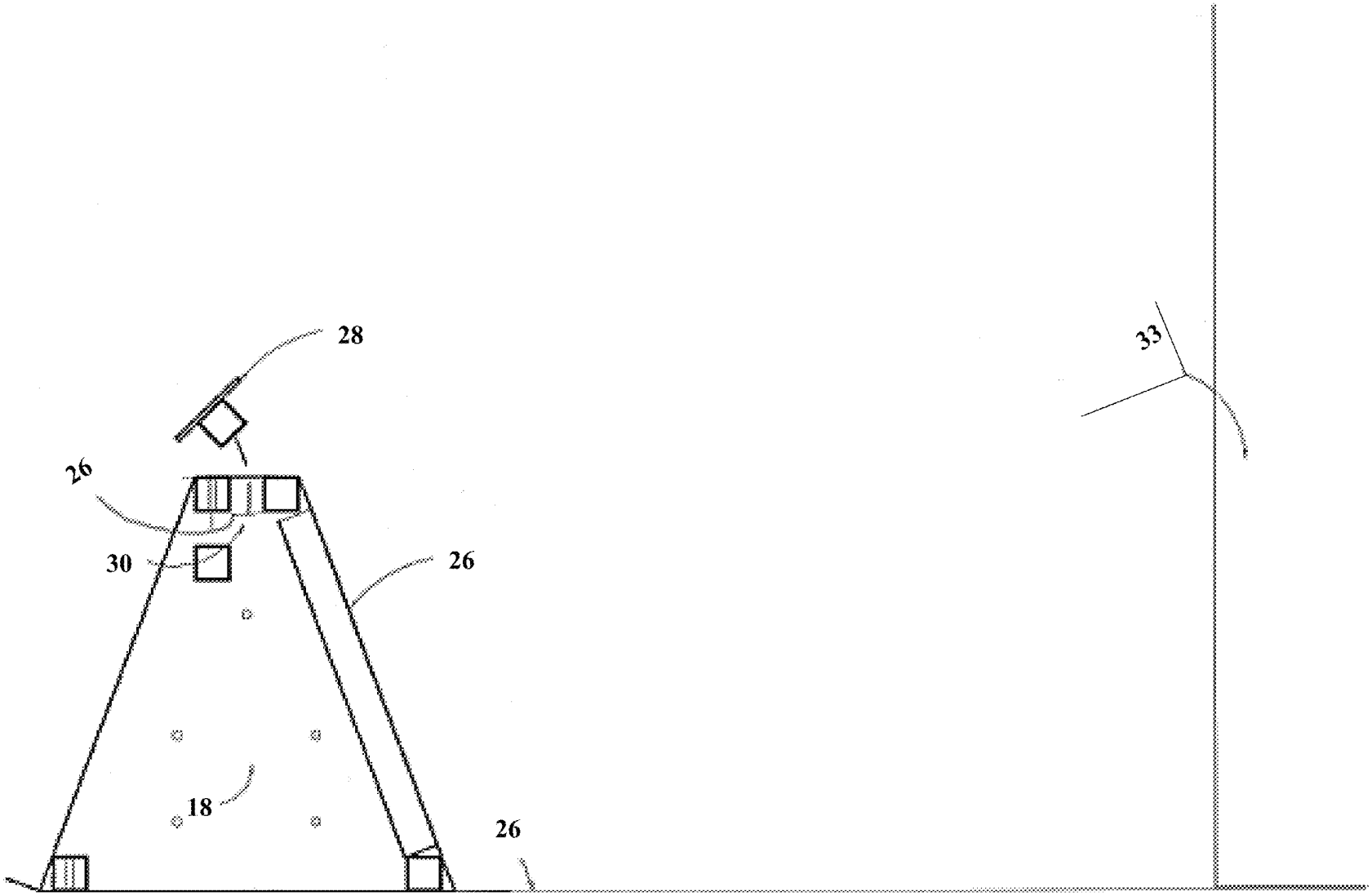
FIGS. 5A and 5B depicts a fluid containment structure, such as that of FIGS. 1-4D, in use with a barrier membrane.
Figure 5B:
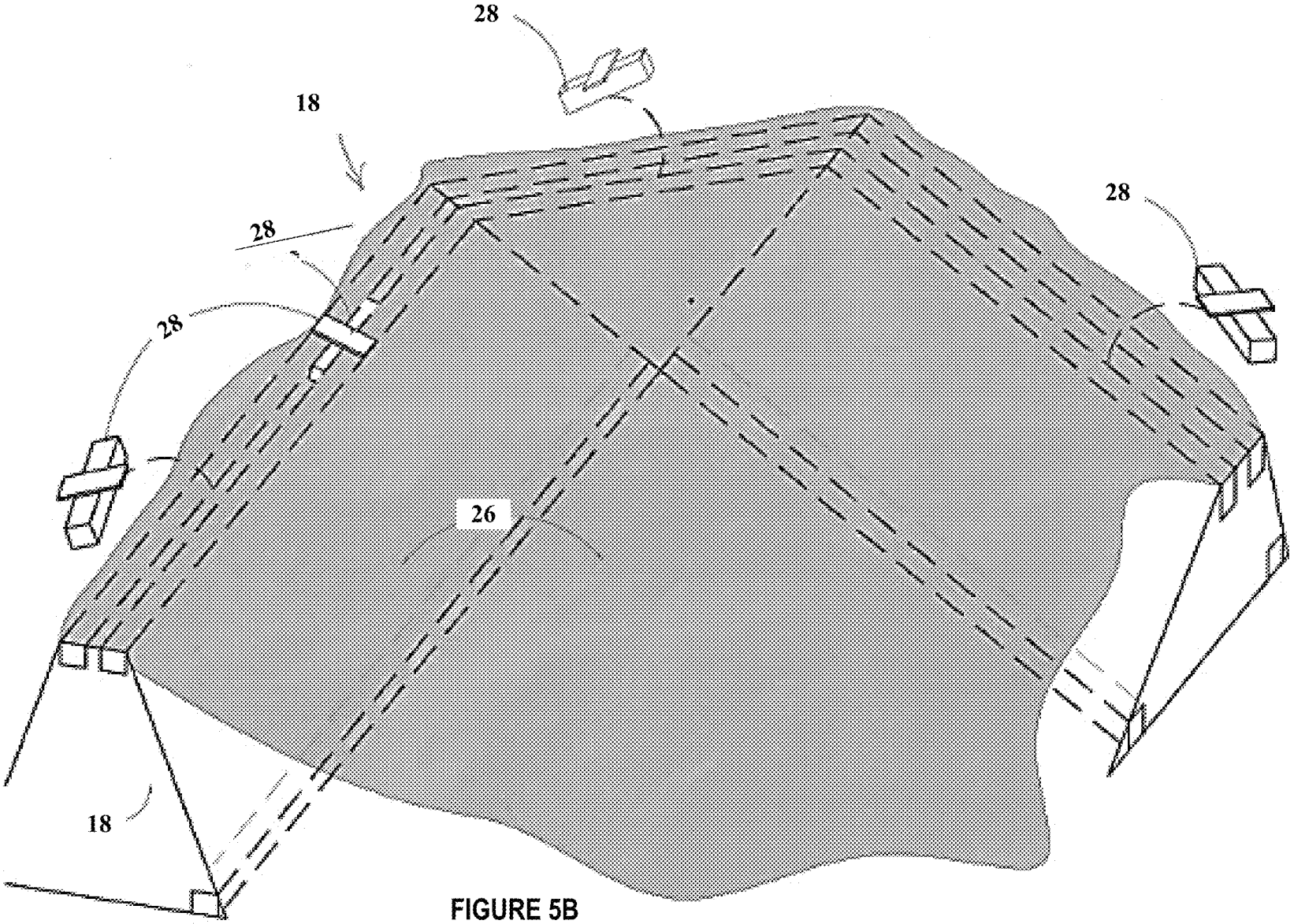

FIGS. 5A and 5B depict a fluid containment structure in use with a barrier membrane 26. The barrier membrane 26 may span the closed wall 18. In certain embodiments, a thin barrier membrane 26 having a 30 mil. thickness may suffice while, in other embodiments, a thicker barrier membrane 26 having an 80 mil. thickness may be required. Various barrier membranes are commonly known in the art.

Figure 6B:
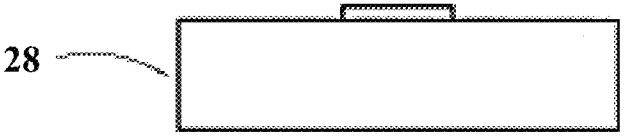
FIGS. 6A and 6B depict an end and side view of a barrier membrane retainer.
Figure 6A:
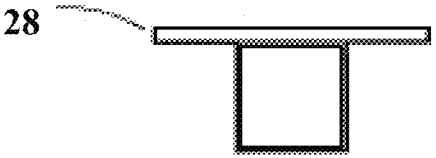

FIGS. 6A and 6B depict an end and side view of a barrier membrane retainer 28. FIGS. 5A and 5B depict barrier membrane retainers 28. Barrier membrane retainers 28 may be sized to fit in the slot 30 formed between the inner top square tubing 10*a* and the outer top square tubing 10*b*. After the barrier membrane 26 is positioned over the wall segments 2, the barrier membrane retainer 28 is placed in the slot 30 with the barrier membrane interposed between the inner top square tubing 10*a*, the outer top square tubing 10*b* and the barrier membrane retainer 28. The barrier membrane retainer 28 may be attached to a wall segment 2 with a screw (not shown) or other know attachment methods. One of skill in the art will understand that the barrier membrane retainer 28 may assume a variety of shapes and still perform the desired function.

As shown in FIG. 5A, a liquid storage tank 32 may be positioned inside closed wall 18 on top of barrier membrane 26. While having a containment system to protect against leakage from a liquid storage tank 32 is an anticipated use of embodiments herein, it is not the only use. It is contemplated that embodiments discussed herein may be used independent of a liquid storage tank 32 to store liquid.

Figure 7A:
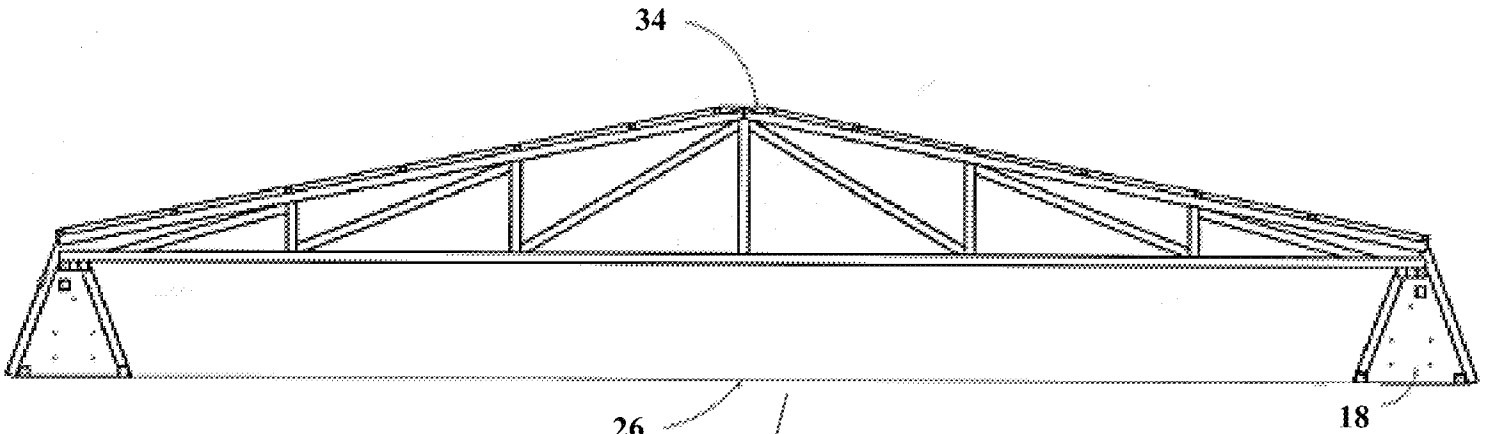
FIGS. 7A-7C depict a truss, for use with the fluid containment structure, including supports that terminate in feet.
Figure 7B:
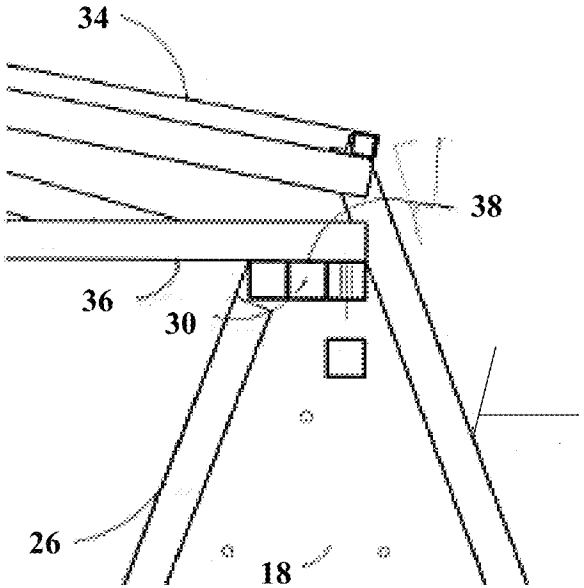
Figure 7C:
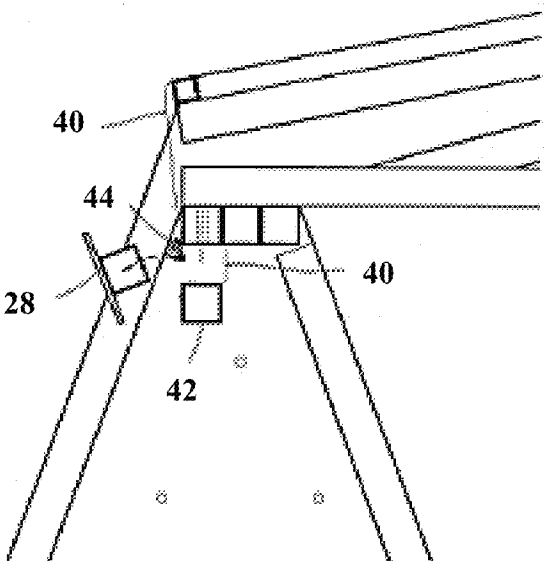

In some embodiments, it may be desirable to cover a liquid retained in the fluid containment system. FIG. 7A depicts a truss 34 placed over an assembled closed wall 18 covered by a barier membrane 26. FIG. 7B depicts a truss 34 including supports 36 that terminate in feet 38. The feet 38 are sized to engage slot 30 and to support the truss 34 above a wall segment 2 or an angular member 14. The feet 38 may be used to connect the truss 34 with the closed wall 18 and to secure the fluid retaining membrane 26 to the closed wall 18. A second membrane 40 may be placed over the truss 34 to protect retained liquid from the environment. As depicted in FIG. 7C, in an embodiment, a fifth square tubing 42 is added to create a second engagement slot 44 into which a membrane retainer 28 may be inserted to secure the second membrane 40 to the closed wall 18.

Many different arrangements of the various components depicted, as well as components not shown, are possible without departing from the spirit and scope hereof. Embodiments have been described with the intent to be illustrative rather than restrictive. Alternative embodiments will become apparent to those skilled in the art that do not depart from its scope of the invention claimed. A skilled artisan may develop alternative means of implementing the aforementioned improvements without departing from the scope hereof. It will be understood that certain features and sub combinations are of utility and may be employed without reference to other features and sub combinations and are contemplated to be within the scope of the claims. The specific configurations and contours set forth in the accompanying drawings are illustrative and not limiting.

What is claimed:

1. A fluid containment system comprising:

a fluid impervious membrane, a first and a second wall segment, each of said first and second wall segments comprising four generally horizontal tubular members, said generally horizontal tubular members joined at a generally triangular end plate at a first and a second end of each of said first and second wall segment, said generally triangular end plate having a base and a top such that a first and a fourth of said horizontal tubular members are attached to the top of the end plate and a second and a third of said horizontal tubular members are attached to the base of the end plate, a generally planar member spanning a distance between the first and the second of said horizontal tubular members on a first side of each of said first and second wall segments, a corner member, said corner member connecting said first and said second wall segments such that said first and second wall segments, when connected, form an angle enabling said first and said second wall segments to couple with an additional plurality of wall segments to form a closed wall; and a membrane securing member, said fluid impervious membrane interposed between said membrane securing member and a slot formed between the first and the fourth of said generally horizontal tubular members such that frictional forces caused by interaction of the membrane securing member with each of the first and fourth generally tubular members and the fluid impervious membrane secure said fluid impervious membrane to said closed wall.

2. The fluid containment system of claim 1 wherein a tensioning member is connected to opposing ones of the wall segments forming the closed wall.

3. The fluid containment system of claim 2 wherein said tensioning member comprises a first and second cable connected to a retaining ring.

4. The fluid containment system of claim 1 wherein said first wall segment is connected to said corner member with four bolts.

5. The fluid containment system of claim 1 wherein said first and second wall segments form a right angle when joined to said corner member.

6. The fluid containment system of claim 1 wherein said first and second wall segments form an obtuse angle when joined to said corner member.

7. A method for containing unintended fluid spills comprising the steps of:

connecting a plurality of wall segments to a plurality of angled corners, said plurality of wall segments comprising:

a plurality of generally horizontal tubular members connected at a first end and a second end to a first and a second generally triangular end piece, respectively, said generally triangular end piece having a base and a top such that a first and a fourth of said horizontal tubular members are attached to the top of the end piece and a second and a third of said horizontal tubular members are attached to the base of the end piece, the first and the second generally triangular end pieces being part of a first and a second ones of the plurality of angled corners, respectively, and a generally planar member interposed between a first and a second ones of the plurality of generally horizontal tubular members, said plurality of angled corners being narrower at an interior than at an exterior of the angled corners;

said plurality of wall segments connected to said plurality of angled corners forming a closed wall;

connecting a first wall segment of the plurality of wall segments to an opposing second wall segment of the plurality of wall segments with a tensioning member;

placing a fluid impervious membrane in a space defined by the closed wall;

securing said fluid impervious membrane to a wall segment by interposing said fluid impervious membrane between a membrane securing member and a slot formed between the first and the fourth of said generally horizontal tubular members such that frictional forces caused by interaction of the membrane securing member with each of the first and fourth generally tubular members and said fluid impervious membrane secure said fluid impervious membrane to said closed wall; and, placing a fluid storage vessel above said fluid impervious membrane and within said closed wall.

8. The method of claim 7 wherein said tensioning member is a cable.

9. The method of claim 7 wherein said tensioning member comprises a plurality of cables connected to a ring interposed between opposing ones of the plurality of wall segments.

10. A fluid containment system comprising:

a barrier wall having a slot, said barrier wall comprising connected barrier wall segments and said slot having a plurality of slot walls, said barrier wall forming a closed wall;

a tensioning member joining opposing ones of the barrier wall segments;

a first fluid impervious membrane spanning a space between opposing barrier wall segments of the connected barrier wall segments, said first fluid impervious membrane being adjacent at least one of said plurality of slot walls; and a fluid impervious membrane securing member sized to be interposed between adjacent ones of said plurality of slot walls with said first fluid impervious membrane interposed between said fluid impervious membrane securing member and one of said plurality of slot walls such that frictional forces caused by interaction of the fluid impervious membrane securing member with each of the adjacent ones of said plurality of slot walls and said first fluid impervious membrane secure said first fluid impervious membrane to said closed wall;

a truss, said truss spanning a distance between opposing ones of the barrier wall segments; said truss supporting a second membrane above said first fluid impervious membrane; and, a plurality of truss supports, said truss supports elevating said truss above said opposing ones of the barrier wall segments and at least one of said truss supports having a foot engageable with said slot.

11. The fluid containment system of claim 10 wherein:

said barrier wall segments comprise a plurality of generally horizontally extending pre-formed members, said generally horizontally extending pre-formed members being joined at a first end and a second end of said barrier wall segments, a planar member spanning a distance between a first and a second of said generally horizontally extending pre-formed members, said planar member positioned on an interior side of said barrier wall segments, and said slot formed between a third of said generally horizontally extending pre-formed members and said first generally horizontally extending pre-formed member.

12. The fluid containment system of claim 10 wherein said foot at least partially secures said first fluid impervious membrane to said barrier wall.

13. The fluid containment system of claim 12 wherein said second membrane is interposed between a second slot and a second membrane securing member sized to secure said second membrane to said barrier wall when inserted into said second slot.

* * * * *